US010779072B2

(12) United States Patent
Kamimura

(10) Patent No.: US 10,779,072 B2
(45) Date of Patent: Sep. 15, 2020

(54) VENT PASSAGE FORMING STRUCTURE IN EARPHONE AND EARPHONE

(71) Applicant: JVC KENWOOD Corporation, Yokohama-shi, Kanagawa (JP)

(72) Inventor: Shinji Kamimura, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/052,731

(22) Filed: Aug. 2, 2018

(65) Prior Publication Data

US 2019/0052948 A1 Feb. 14, 2019

(30) Foreign Application Priority Data

Aug. 8, 2017 (JP) ..... 2017-152878
Aug. 8, 2017 (JP) ..... 2017-152879

(51) Int. Cl.
*H04R 1/10* (2006.01)
*H04R 1/28* (2006.01)

(52) U.S. Cl.
CPC ..... *H04R 1/1016* (2013.01); *H04R 1/1075* (2013.01); *H04R 1/2826* (2013.01); *H04R 2460/11* (2013.01)

(58) Field of Classification Search
None
See application file for complete search history.

(56) References Cited

U.S. PATENT DOCUMENTS

2012/0243725 A1* 9/2012 Takai ..... H04R 1/1016 381/380
2014/0348372 A1* 11/2014 Seo ..... H04R 1/1016 381/380
2016/0295315 A1* 10/2016 Kuwahara ..... H04R 1/1016

FOREIGN PATENT DOCUMENTS

JP 5575435 B2 7/2014

* cited by examiner

*Primary Examiner* — Kenny H Truong
(74) *Attorney, Agent, or Firm* — Nath, Goldberg & Meyer; Jerald L. Meyer

(57) ABSTRACT

A vent passage forming structure includes a penetration hole portion, a groove portion and a vent passage forming plate. The penetration hole portion is formed on a housing of an earphone. A space on one side of the housing communicates with a space on the other side of the housing through the penetration hole portion. The groove portion is formed on a surface of the housing on the one side thereof to be connected with the penetration hole portion. The vent passage forming plate covers the penetration hole portion and a part of the groove portion. A vent passage through which the space on the one side communicates with space on the other side, is formed by a hole space that is an inner space of the penetration hole portion, and a groove space that is surrounded by the groove portion and the vent passage forming plate.

4 Claims, 8 Drawing Sheets

VENT PASSAGE FORMING STRUCTURE IN EARPHONE AND EARPHONE

CROSS REFERENCE TO RELATED APPLICATION

This application is based upon and claims the benefit of priority under 35 U.S.C. § 119 from Japanese Patent Applications No. 2017-152878, filed on Aug. 8, 2017 and No. 2017-152879, filed on Aug. 8, 2017, the entire contents of which are incorporated herein by reference.

BACKGROUND

The present invention relates to a vent passage forming structure in an earphone and the earphone. More particularly, the present invention relates to a vent passage forming structure in an earphone for forming a vent passage having a smaller sectional area, and the earphone including the structure.

Earphones are sometimes provided with a vent passage that allows ventilation between an inner space and an outer space of a housing. For example, an earplug type earphone (also called as a canal type earphone) in use has its ear piece closely fit to an inner surface of an external auditory canal. This results in a high degree of airtightness between a front space of a diaphragm and an inner space of the external auditory canal. When the earphone is fit to or removed from the ear, there is a possibility of increase or decrease in pressure in the front space, which applies a load to the diaphragm.

There has been known a technique of providing a vent passage through which the front space communicates with the outer space to eliminate the increase and decrease in pressure in the front space to reduce the load applied on the diaphragm. Moreover, there has been known a technique of proving a vent passage that enables ventilation between the front space or the rear space of the diaphragm and the outer space to adjust acoustic characteristics in reproduction, which is not limited to the earplug type earphone. Japanese Patent No. 5575435 (Patent Literature 1) describes an earphone having these vent passages as holes.

A housing of the earphone is usually made of a resin by injection molding with the view of placing importance to costs and mass productivity. A pin for forming a hole in a die for injection molding of the housing has a diameter equal to or more than a prescribed value to give strength to the pin to avoid a break, a damage, and the like in the mass production molding. The prescribed value for the diameter is typically approximately 0.8 mm in diameter. That is, a hole formed on the housing desirably has a diameter approximately equal to or more than 0.8 mm.

On the other hand, in a case of proving the hole as a vent passage, a difference in vent passage sectional areas, which are determined according to the diameters of the holes, quickly reflects to acoustic characteristics in reproduction. As a general tendency, sound pressure in low register goes higher as the vent passage sectional area is made smaller, which results in preferable sounds in reproduction. The vent passage sectional area is an area of a section orthogonal to an extending direction of the vent passage (a direction of flow of an air). The housing of the earphone has a small volume from the first. It is thus necessary to make a hole, as the vent passage, as small in diameter as possible to obtain preferable sounds in reproduction with enhanced sound pressure in low register. However, as previously described, a hole smaller than about 0.8 mm in diameter has a higher possibility of a pin break in mass production molding as the hole is made smaller in diameter, which lowers the productivity. Accordingly, a contrivance to make the vent passage sectional area smaller without lowering the productivity has been desired.

SUMMARY

According to a first aspect of the embodiments, there is provided a vent passage forming structure of an earphone including: a penetration hole portion through which a space on one side of a housing communicates with a space on the other side of the housing, that is formed on the housing of the earphone and; a groove portion that is formed on a surface of the housing on the one side thereof to be connected with the penetration hole portion; and a vent passage forming plate that covers the penetration hole portion and a part of the groove portion which is located at a side of the penetration hole portion, wherein a vent passage through which the space on the one side communicates with the space on the other side, is formed by a hole space that is an inner space of the penetration hole portion and a groove space that communicates with the hole space and is surrounded by the groove portion and the vent passage forming plate.

According to a second aspect of the embodiments, there is provided a vent passage forming structure of an earphone including: a first penetration hole portion through which a space on one side of a housing communicates with a space on the other side of the housing, that is formed on the housing of the earphone; and a vent passage forming plate that includes a second penetration hole portion having a hole smaller than a hole of the first penetration hole portion, and is mounted to cover the first penetration hole portion such that the hole of the second penetration hole portion communicates with the hole of the first penetration hole portion, wherein a vent passage through which the space on the one side communicates with the space on the other side, is formed by a first hole space that is an inner space of the hole of the first penetration hole portion and a second hole space that is an inner space of the hole of the second penetration hole portion.

According to a third aspect of the embodiments, there is provided an earphone including: a speaker unit that includes a diaphragm; a housing that receives the speaker unit therein to form a first space on one side with respect to the diaphragm and a second space on the other side with respect to the diaphragm; a penetration hole portion through which an outer space communicates with the first space or the second space of the housing, that is formed on the housing; a groove portion that is formed on an outer surface or an inner surface of the housing to be connected with the penetration hole portion; and a vent passage forming plate that covers the penetration hole portion and a part of the groove portion, wherein a vent passage through which the outer space communicates with the first space or the second space, is formed by a hole space that is an inner space of the penetration hole portion and a groove space that communicates with the hole space and is surrounded by the groove portion and the vent passage forming plate.

According to a fourth aspect of the embodiments, there is provided an earphone including: a speaker unit that includes a diaphragm; a housing that receives the speaker unit therein to form a first space on one side with respect to the diaphragm and a second space on the other side with respect to the diaphragm; a first penetration hole portion through which an outer space communicates with the first space or the second space of the housing, that is formed on the housing; and a vent passage forming plate that includes a second penetration hole portion having a hole smaller than a hole of the first penetration hole portion, and is mounted to cover the first penetration hole portion such that the hole of the second penetration hole portion communicates with the hole of the first penetration hole portion, wherein a vent passage through which the outer space communicates with the first space or the second space, is formed by a first hole space that is an inner space of the hole of the first penetration hole portion and a second hole space that is an inner space of the hole of the second penetration hole portion.

DETAILED DESCRIPTION

Vent passage forming structures of earphones according to a first exemplary embodiment and a second exemplary embodiment of the present invention will be described below.

First Embodiment

Figure 1:
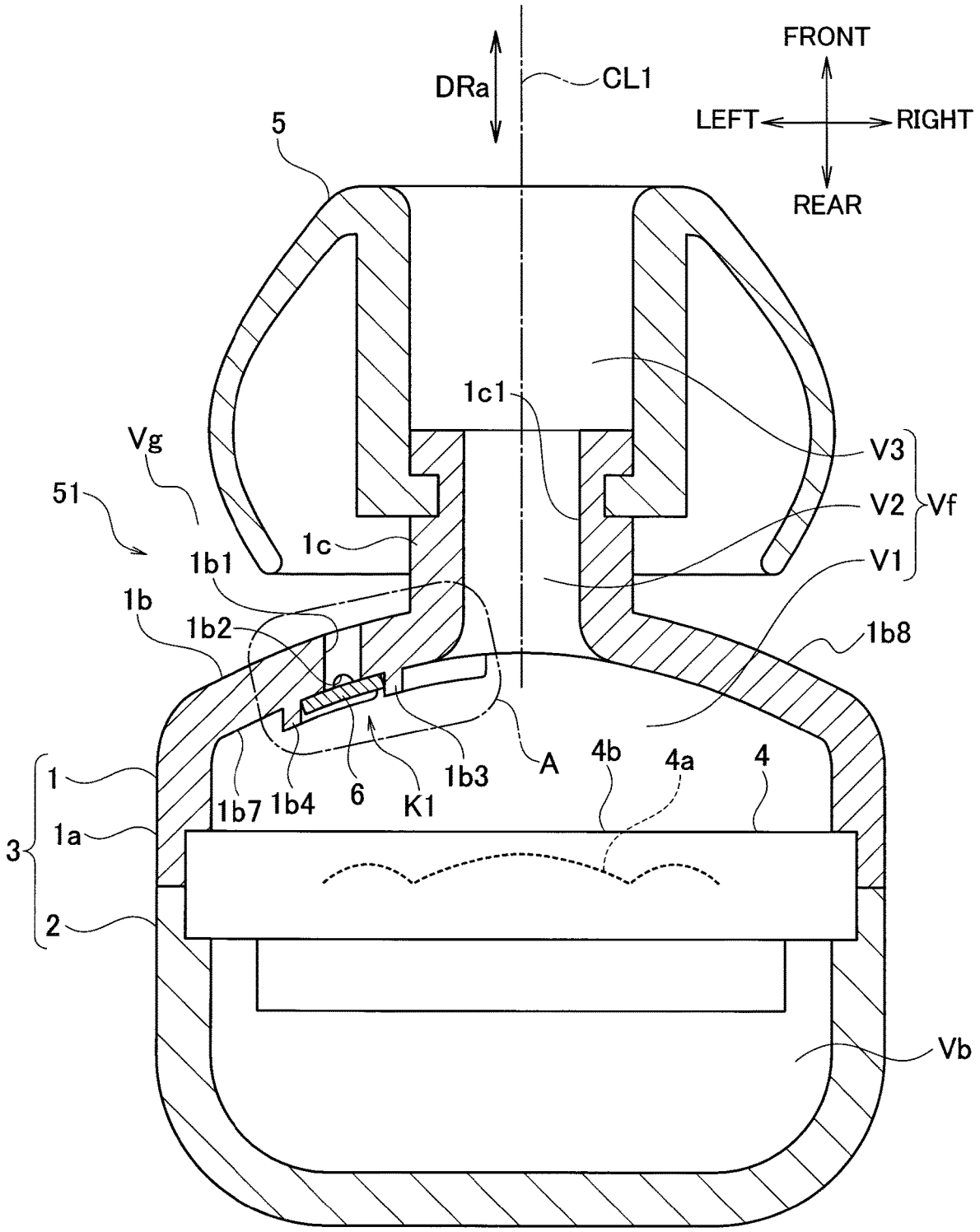
FIG. 1 is a sectional view of an earphone according to a first exemplary embodiment of the present invention.

FIG. 1 is a typical sectional view of an earphone 51 including a vent passage forming structure K1. Left and right directions, and front and rear directions are defined by arrows shown in FIG. 1 for ease of explanation. The earphone 51 is an earplug type earphone.

The earphone 51 includes a housing 3 configured by combining a front housing 1 and a rear housing 2 in the front and rear directions. At least, the front housing 1 is made of a resin by injection molding. For example, the resin is a PC (polycarbonate).

The housing 3 receives a speaker unit 4 therein. The speaker unit 4 includes a diaphragm 4*a* and has a flat round column shape that is thin in the front and rear directions. As shown in FIG. 1, the speaker unit 4 is sandwiched and fixed between the front housing 1 and the rear housing 2, for example. The speaker unit 4 is mounted such that a sound emission surface 4*b* thereof, which outputs sounds, is on a front side of the speaker unit 4. The speaker unit 4 divides an inner space of the housing 3 into a front space and the rear space without ventilation.

The front housing 1 includes a body portion 1*a* around a central axial line CL1, which has a maximum diameter in the front housing 1, a front wall portion 1*b* at which a diameter thereof shrinks from the body portion 1*a* in the front direction in an approximate cone shape, and a sound tube portion 1*c* formed to protrude in the front direction along the central axial line CL1 from a middle portion of the front wall portion 1*b*. The sound tube portion 1*c* includes a sound emission hole 1*c*1, which penetrates along the central axial line CL1. An ear piece 5 is removably mounted on a peripheral surface of the sound tube portion 1*c*. The ear piece 5 is made of a material having flexibility, such as a silicone rubber.

A space V1 and a space V2 are defined within the front housing 1. The space V1 is surrounded by the front wall portion 1*b* and the speaker unit 4. The space V2, which is an inner space of the sound emission hole 1*c*1 of the sound tube portion 1*c*, communicates with the space V1 at a front side of the space V1. Moreover, a space V3, which is an inner space of the ear piece 5 communicates with the space V2 at a front side of the space V2. The spaces V1 to V3 are a front space Vf with respect to the diaphragm 4*a*.

The earphone 51 includes the vent passage forming structure K1 on the front wall portion 1*b* of the front housing 1. Next, the vent passage forming structure K1 will be described with reference to FIGS. 2 to 5.

Figure 2:
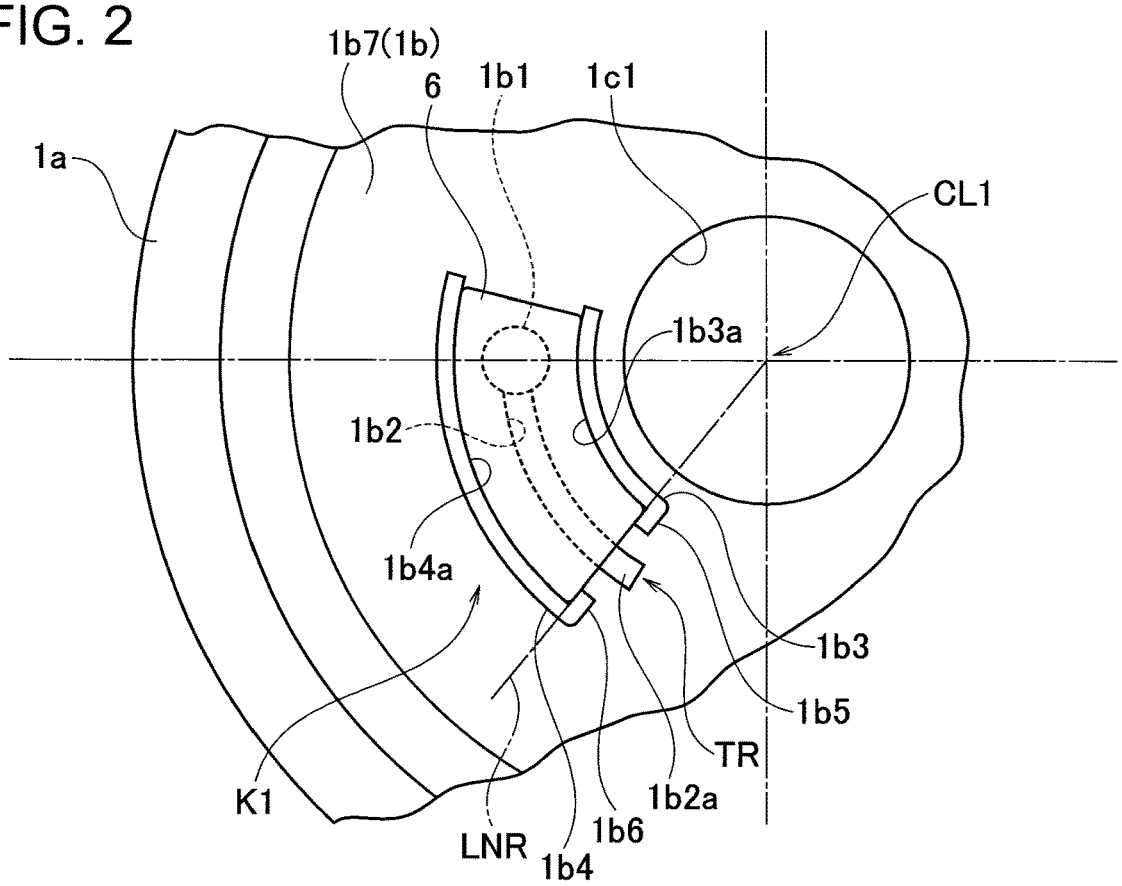
FIG. 2 is a partial rear diagram illustrating a vent passage forming structure included in the earphone according to the first exemplary embodiment.
Figure 3:
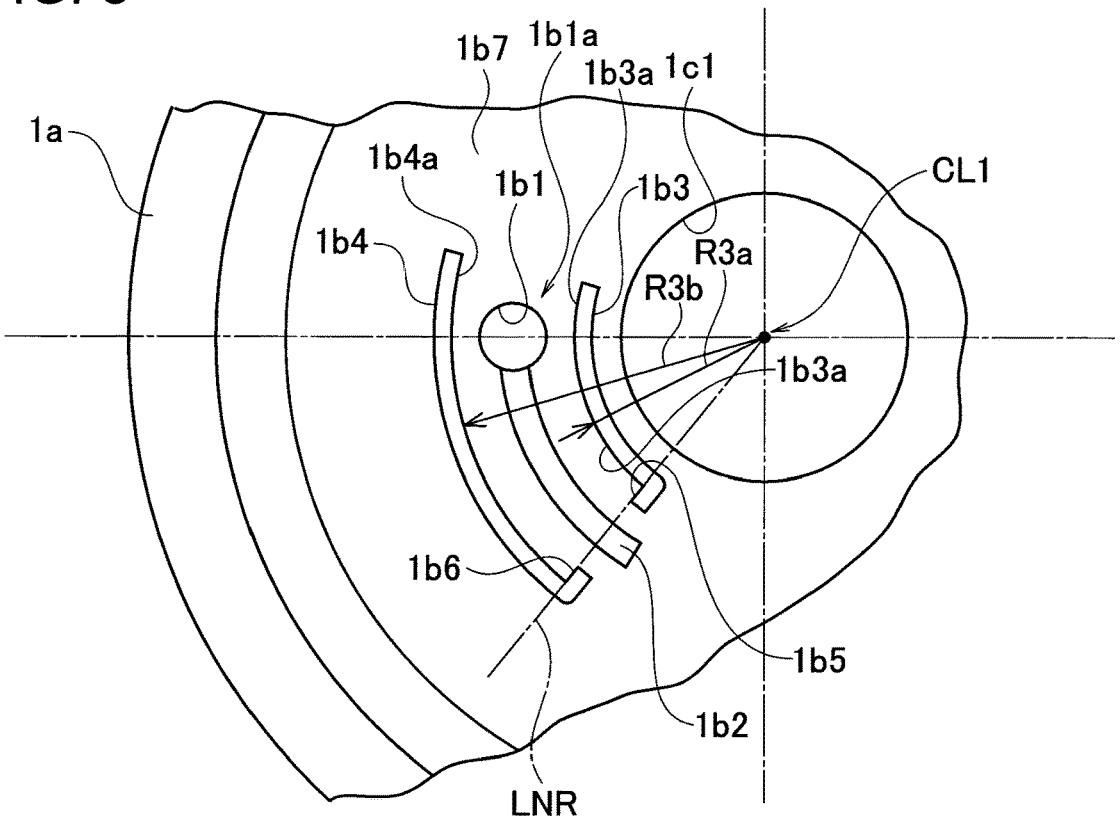
FIG. 3 is a partial rear diagram illustrating a front housing in the vent passage forming structure according to the first exemplary embodiment.
Figure 4A:
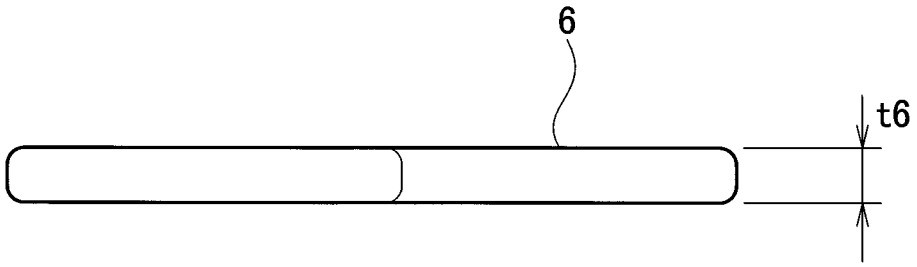
FIG. 4A is a side view of a vent passage forming plate included in the vent passage forming structure according to the first exemplary embodiment.
Figure 4B:
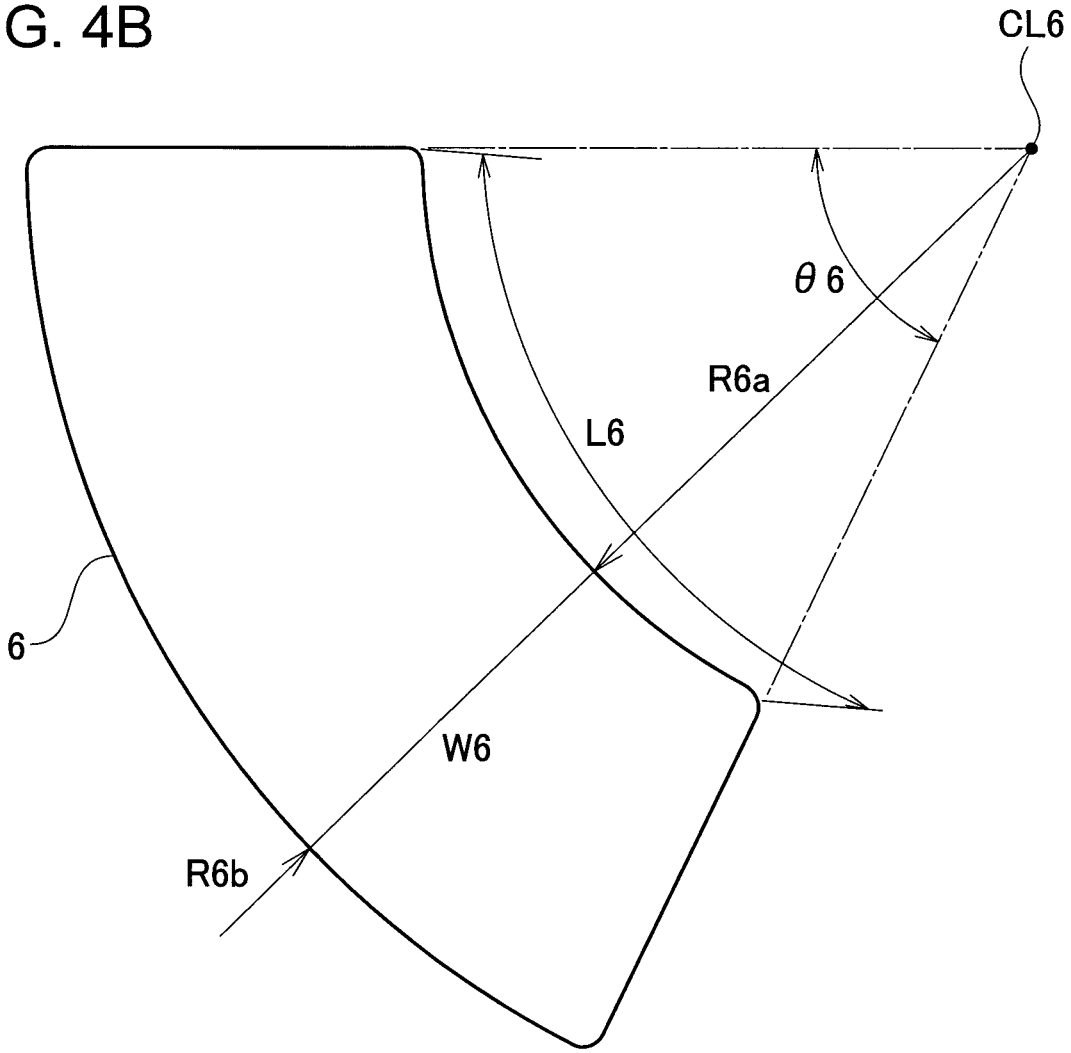
FIG. 4B is a plane view of the vent passage forming plate included in the vent passage forming structure according to the first exemplary embodiment.
Figure 5:
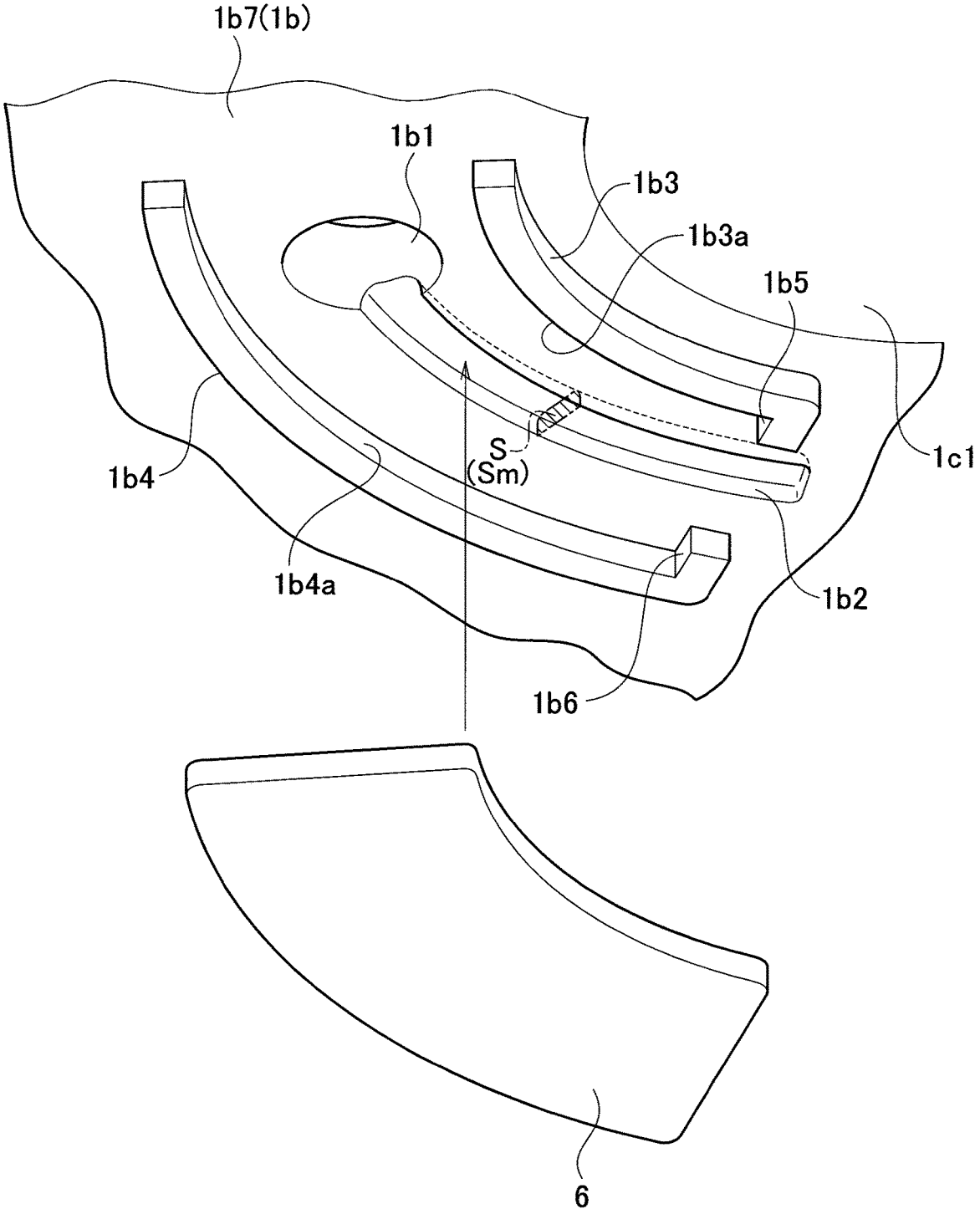
FIG. 5 is a perspective assembly diagram illustrating the vent passage forming structure according to the first exemplary embodiment.

FIG. 2 is a partial rear diagram of the vent passage forming structure K1 viewed from the rear in FIG. 1. FIG. 3 corresponds to FIG. 2 and illustrates the front housing 1 without a vent passage forming plate 6. FIG. 4A is a side view of the vent passage forming plate 6. FIG. 4B is a front view of the vent passage forming plate 6. FIG. 5 is a perspective assembly diagram illustrating mounting of the vent passage forming plate 6 on the front wall portion 1*b*, which is viewed from the diagonal rear of the vent passage forming structure K1. It is noted that FIGS. 2 and 3 are illustrated as plane view drawings for ease of drawing and understanding, whereas FIGS. 2 and 3, which are the rear diagrams, are supposed to be perspective drawings because the front wall portion 1*b* is an inclined surface. This is the same for FIGS. 6 and 8 below.

The vent passage forming structure K1 includes a penetration hole portion 1*b*1, a groove portion 1*b*2, and the vent passage forming plate 6, which is in a board shape and mounted to cover at least the penetration hole portion 1*b*1 and a part of the groove portion 1*b*2. The penetration hole portion 1*b*1 is formed on the front wall portion 1*b* to penetrate in the front and rear directions. The groove portion 1*b*2 is formed on a rear surface 1*b*7 of the front wall portion 1*b* to extend in a circular arc shape as a concave portion communicating with the penetration hole portion 1b1. The penetration hole portion 1b1 has a hole through which a space on one side of the front wall portion 1b communicates with a space on the other side of the front wall portion 1b.

Moreover, the vent passage forming structure K1 may include an inner guide rib 1b3 formed at an inner side of the groove portion 1b2 in a diameter direction of the front wall portion 1b, and an outer guide rib 1b4 formed at an outer side of the groove portion 1b2 in the diameter direction. In the following, a structure including these ribs will be described in detail.

The front housing 1 is formed such that directions of the central axial line CL1 shown in FIG. 1 are mold opened directions DRa in injection molding. The penetration hole portion 1b1 is formed on the front wall portion 1b to extend in the mold opened directions DRa and has a hole through which an inner space of the housing 1 communicates with an outer space of the housing 1. That is, the penetration hole portion 1b1 is formed by, for example, a pin stood on a core of a die, which is a pair of the core and a cavity, in injection molding. The shape of the penetration hole portion 1b1 is defined such that the pin stood on the core has strength bearable enough for mass production molding, such as a circular hole of 0.8 mm in diameter.

The groove portion 1b2 formed to be connected with the penetration hole portion 1b1 is formed in a circular arc shape around the central axial line CL1 viewed from the rear. A sectional shape (cross-sectional shape) of the groove portion 1b2 in the diameter direction may be in any shape, such as a rectangular shape, a half circle shape, a triangular shape, or a combination thereof. A cross-sectional area Sm of the groove portion 1b2 may be constant, or may not be constant along an extending direction of the circular arc shape. The cross-sectional area Sm when it is constant, or a minimum cross-sectional area when it is not constant is defined as a vent passage sectional area S (see FIG. 5) as described below. Here, the groove portion 1b2 having the cross-sectional area Sm formed constant will be described as an example.

As shown in FIGS. 4A and 4B, the vent passage forming plate 6 is a board member in an arc shape having a width W6, a circumferential length L6, and a thickness t6. The width W6 is constant between a radius R6*a* and a radius R6*b* with respect to an imaginary center CL6. The circumferential length L6 is a length corresponding to a range of an angle θ 6 at the center CL6. The vent passage forming plate 6 may be made of any material that has no permeability, such as a PET (polyethylene terephthalate) resin. The width W6 and the circumferential length L6 are defined in shapes and sizes to completely cover the penetration hole portion 1b1 formed on the front wall portion 1b. The vent passage forming plate 6 is configured to cover the penetration hole portion 1b1, and the whole or at least a part of the groove portion 1b2 connected with the penetration hole portion 1b1.

As shown in FIG. 3, the inner guide rib 1b3 is formed to have an outer surface 1b3*a* as a curved surface in a circular arc shape with a radius R3*a* around the central axial line CL1. The outer guide rib 1b4 is formed to have an inner surface 1b4*a* as a curved surface in a circular arc shape with a radius R3*b* around the central axial line CL1. The radius R3*a* is defined as a value slightly smaller than that of the radius R6*a* of the vent passage forming plate 6. The radius R3*b* is defined as a value slightly larger than that of the radius R6*b* of the vent passage forming plate 6. Accordingly, as shown in FIG. 2, the vent passage forming plate 6 is received between the inner guide rib 1b3 and the outer guide rib 1b4 to be positioned in the diameter direction.

The vent passage forming plate 6 is mounted on an area between the inner guide rib 1b3 and the outer guide rib 1b4 on the rear surface 1b7 of the front wall portion 1b by a glue, a double-sided adhesive tape, or the like. The vent passage forming plate 6 is mounted on the rear surface 1b7 to cover an opening 1b1*a* of the penetration hole portion 1b1 (FIG. 3) and at least a part of the groove portion 1b2, which is connected with the penetration hole portion 1b1, by a worker or a work robot. Only an end portion of the groove portion 1b2, which is far from the penetration hole portion 1b1, is not covered by the vent passage forming plate 6 to be exposed as an opening 1b2*a* of the groove portion 1b2 (see FIG. 2).

The vent passage forming structure K1 may have a position regulating portion 1b5 and a position regulating portion 1b6 extending from the inner guide rib 1b3 and the outer guide rib 1b4, respectively, to approach each other along a radius line LNR (FIGS. 2 and 3) passing the central axial line CL1. The position regulating portions 1b5, 1b6 guide the vent passage forming plate 6 to a mounting position in a circumferential direction of the front wall portion 1b. That is, a worker only applies the vent passage forming plate 6 to the position regulating portions 1b5, 1b6, which enables the worker to mount the vent passage forming plate 6 at a designated position in the circumferential direction without caring about fine positioning. This simplifies the mounting. The position regulating portions 1b5, 1b6 are a guide that enables the worker to at least visually confirm the mounting position of the vent passage forming plate 6.

The circumferential length L6 of the vent passage forming plate 6, and forming positions of the position regulating portions 1b5, 1b6 are defined such that the vent passage forming plate 6 covers the penetration hole portion 1b1 and a part of the groove portion 1b2, and further the end portion of the groove portion 1b2, which is far from the penetration hole portion 1b1, is not covered by the vent passage forming plate 6 to be the opening 1b2*a* of the groove portion 1b2 (see FIG. 2).

In the above-described vent passage forming structure K1, the penetration hole portion 1b1 and the groove portion 1b2, and the vent passage forming plate 6 form a vent passage TR through which the inner space of the front wall portion 1b communicates with the outer space of the front wall portion 1b. More concretely, the vent passage TR is formed by a hole space that is an inner space of the penetration hole portion 1b1, and a groove space that is a space surrounded by the groove portion 1b2 and the vent passage forming plate 6. The groove space is a space that has one end thereof communicating with the hole space, and the other end thereof opening as the opening 1b2*a*.

The definition of the cross-sectional shape and the size of the groove portion 1b2 enables the vent passage sectional area S to be smaller than a hole sectional area Sh of the penetration hole portion 1b1 in the vent passage forming structure K1. For example, in a case of defining the penetration hole portion 1b1 as a hole of 0.8 mm in diameter, the hole sectional area Sh is about 0.50 $mm^2$. Here, in a case of defining the groove portion 1b2 as having a width of 0.7 mm and a depth of 0.1 mm, the vent passage sectional area S is 0.07 $mm^2$, which is smaller than the hole sectional area Sh. Accordingly, the vent passage TR is formed to have a significantly small vent passage sectional area in comparison with a case of configuring the vent passage by only the penetration hole portion 1b1.

In the vent passage forming structure K1, a portion of the core for forming the groove portion 1b2 in injection molding is not a pin stood on the surface of the core, but a rib-shaped portion protruding from the core surface, so that durability of the die is higher than that of a die having the pin. Accordingly, a possibility of having malfunctioning, such as a damage, or a break in mass production molding, is low when the width and the depth of the groove portion 1*b*2 are made small. In particular, making the depth of the groove portion 1*b*2 small and the width of the groove portion 1*b*2 wide forms a convex line portion that is low in height and large in width on the corresponding core, thereby further enhancing the durability of the die.

The vent passage TR through which the front space Vf communicates with an outer space Vg is formed on the front wall portion 1*b* of the front housing 1 of the earphone 51 including the above-described vent passage forming structure K1. The definition of the cross-sectional area Sm of the groove portion 1*b*2 enables the vent passage TR to easily have the vent passage sectional area S smaller than the hole sectional area Sh of the penetration hole portion 1*b*1. Accordingly, this enables the earphone 51 to obtain a fine acoustic characteristic in reproduction with high sound pressure in low register while enhancing the strength of the pin for molding the penetration hole portion 1*b*1 not to lower the productivity. Moreover, this eliminates increase and decrease in pressure in the front space Vf when the earphone 51 is fit to or removed from an ear and thus reduces a load on the diaphragm 4*a*.

Figure 6:
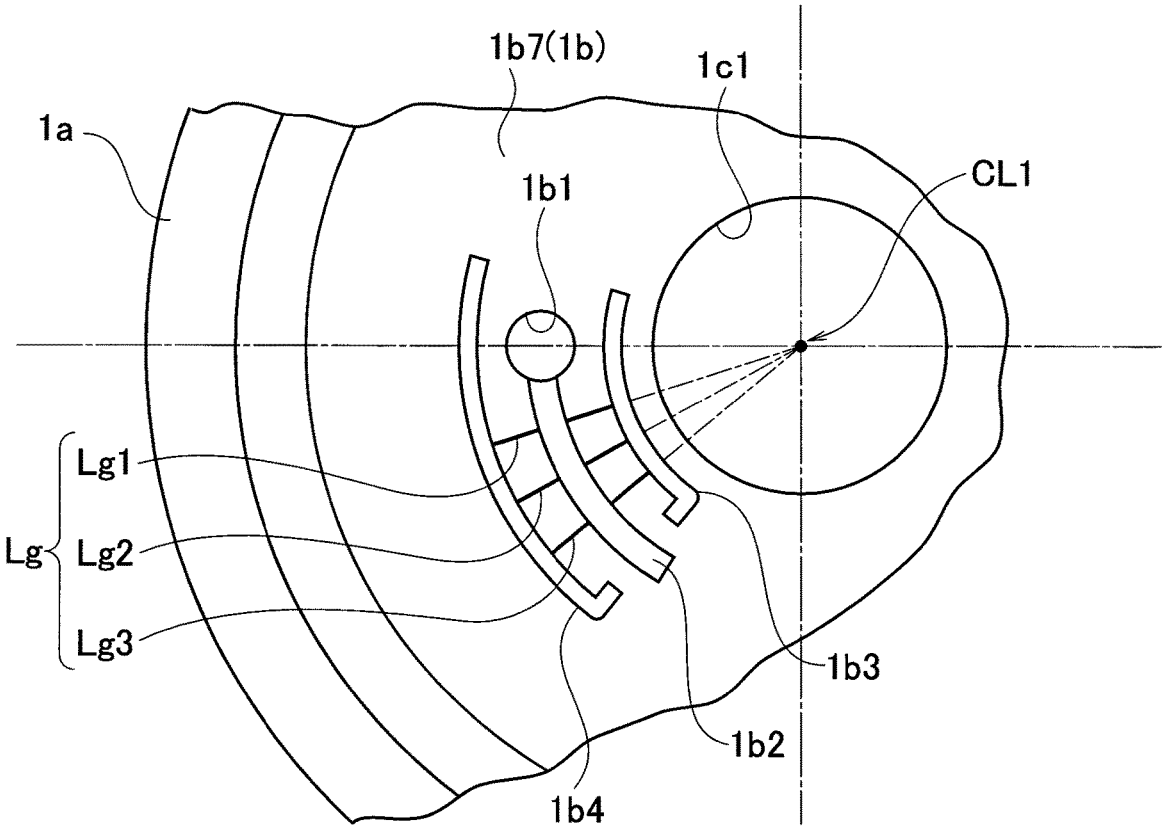
FIG. 6 is a partial rear diagram illustrating a modification of the front housing of the vent passage forming structure according to the first exemplary embodiment.

As shown in FIG. 6, when the vent passage forming structure K1 is provided with the inner guide rib 1*b*3 and the outer guide rib 1*b*4, guide lines Lg may be formed in a radial manner around the central axial line CL1 on the mounting area of the vent passage forming plate 6 between the inner guide rib 1*b*3 and the outer guide rib 1*b*4. FIG. 6 illustrates an example of providing three guide lines Lg1 to Lg3 for visual confirmation, each of which has a different distance from the penetration hole portion 1*b*1. The guide lines Lg are formed by providing marking-off lines on the surface of the core, for example.

The guide lines Lg are aims of positions in the circumferential direction when the worker mounts the vent passage forming plate 6. That is, the guide lines Lg are a guide that enables the worker to at least visually confirm the mounting position of the vent passage forming plate 6. Accordingly, the worker adjusts a position of the end portion of the vent passage forming plate 6 not only to the position regulating portions 1*b*5, 1*b*6, but also to one of the guide lines Lg1 to Lg3 to mount the vent passage forming plate 6. As a result, the worker easily obtains the vent passage TR with respective lengths corresponding to the guide lines Lg1 to Lg3 with high accuracy. Typically, the length (duct length) of the vent passage (duct) through which the inner space of the housing communicates with the outer space of the housing has an influence on the acoustic characteristics in reproduction as well as the vent passage sectional area S. Tone control is thus performed, by adjusting the mounting position of the vent passage forming plate 6 to change the length of the vent passage TR. The provision of the position regulating portions 1*b*5, 1*b*6, and the guide lines Lg reduces variation in working and enables the length of the vent passage TR to be accurately adjusted to the constant values.

As described above, the vent passage TR through which the inner space of the front wall portion 1*b* communicates with the outer space of the front wall portion 1*b* is formed by covering the front wall portion 1*b* with the vent passage forming plate 6. The vent passage TR is the combination of the whole penetration hole portion 1*b*1, and a part of the groove portion 1*b*2 on one end thereof communicating with the penetration hole portion 1*b*1. This enables the cross-sectional area Sm of the groove portion 1*b*2, which is as the vent passage sectional area S, to be made smaller than the hole sectional area Sh of the penetration hole portion 1*b*1. Accordingly, the vent passage TR through which the front space Vf of the front housing 1 communicates with the outer space Vg of the front housing 1 is formed to have the vent passage sectional area S smaller without lowering the productivity.

Second Embodiment

Next, a vent passage forming structure K2 according to a second exemplary embodiment will be described with reference to FIGS. 7 to 9B. The vent passage forming structure K2 is configured to include a front housing 21 and a vent passage forming plate 26, which are different in shapes, respectively, from the corresponding front housing 1 and the vent passage forming plate 6 of the vent passage forming structure K1 according to the first exemplary embodiment. An earphone 52 has the vent passage forming structure K2 instead of the vent passage forming structure K1 of the earphone 51. Other parts of the earphone 52 are the same as those of the earphone 51.

Figure 7:
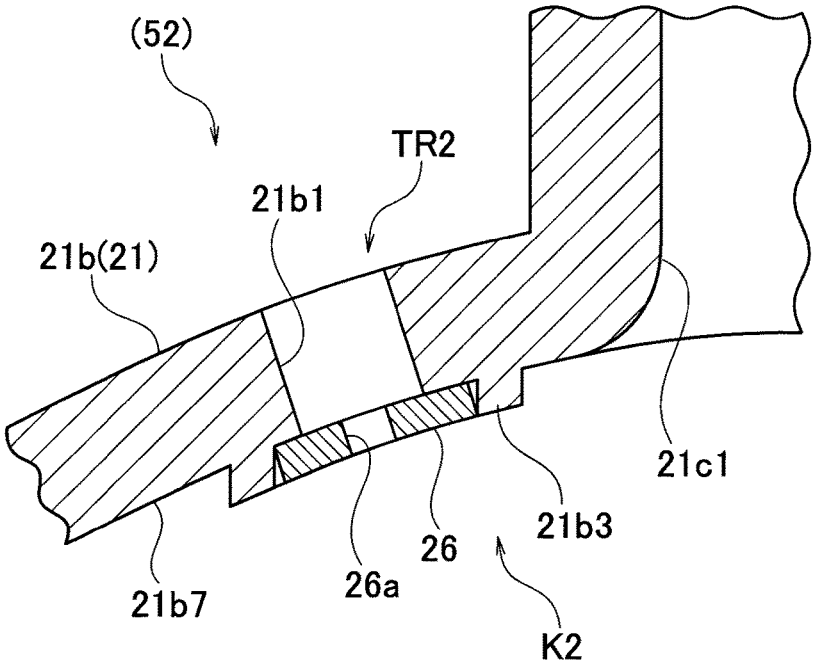
FIG. 7 is a partial sectional diagram illustrating a vent passage forming structure included in an earphone according to a second exemplary embodiment.
Figure 8:
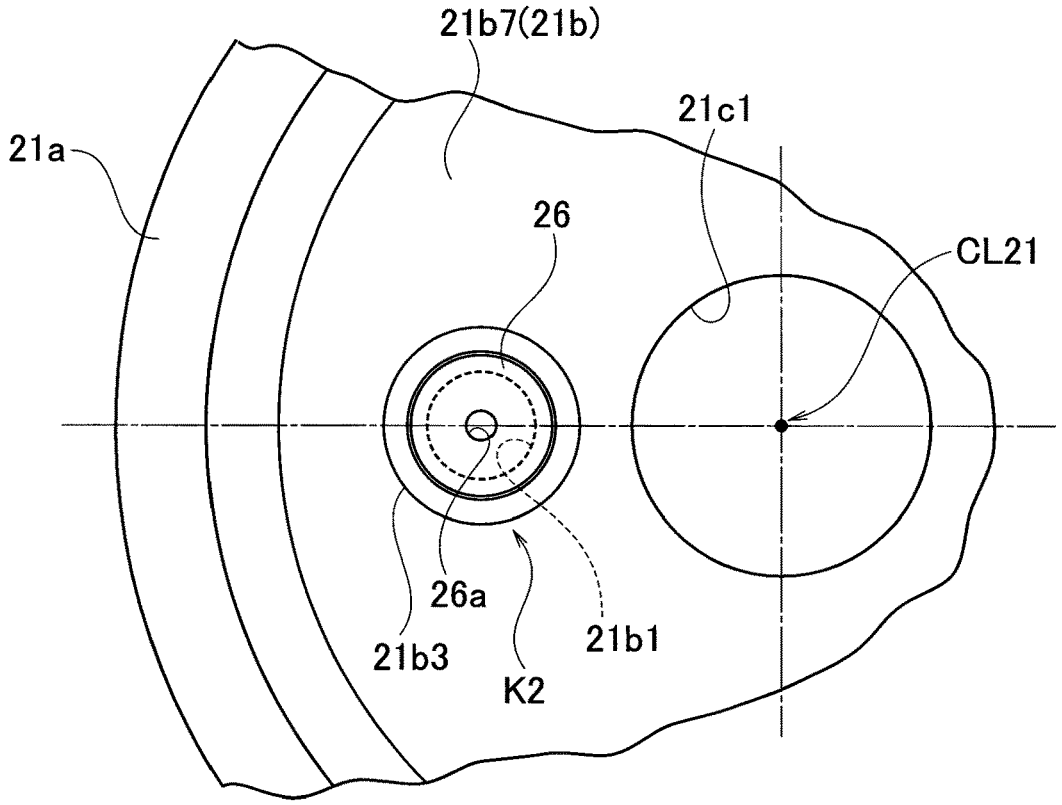
FIG. 8 is a partial rear diagram illustrating the vent passage forming structure according to the second exemplary embodiment.
Figure 9A:
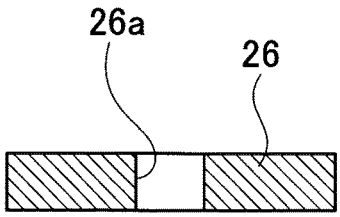
FIG. 9A is a sectional view of a vent passage forming plate included in the vent passage forming structure according to the second exemplary embodiment.
Figure 9B:
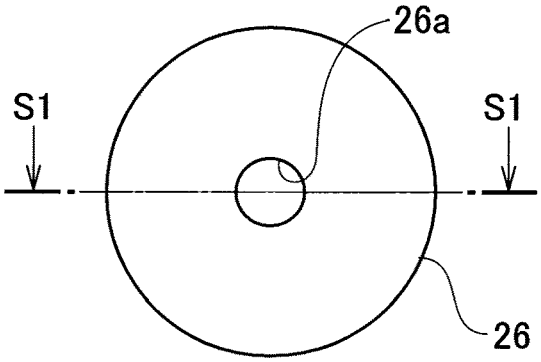
FIG. 9B is a plane view of the vent passage forming plate included in the vent passage forming structure according to the second exemplary embodiment.

FIG. 7 is a partial sectional diagram illustrating a main part of the earphone 52 corresponding to a part A in FIG. 1. FIG. 8 is a rear diagram illustrating the main part and its vicinity. FIG. 9B is a plane view of the vent passage forming plate 26. FIG. 9A is a sectional view taken along a line S1-S1 in FIG. 9B.

The front housing 21 includes a penetration hole portion 21*b*1 corresponding to the penetration hole portion 1*b*1 of the front housing 1. A guide rib 21*b*3 in a circular ring shape surrounding the penetration hole portion 21*b*1 is formed to protrude in the rear direction on a rear surface 21*b*7 of the front wall portion 21*b* of the front housing 21. The vent passage forming plate 26 in a circular disc shape is mounted in an inner circular area of the guide rib 21*b*3 by a glue or a double-sided adhesive tape.

As shown in FIGS. 9A and 9B, the vent passage forming plate 26 is formed in a circular disc shape and has a penetration hole portion 26*a* at the center position thereof. The vent passage forming plate 26 is made of a soft resin board that is easy of die cutting processing, such as a resin board of PET. A hole sectional area Sm2 of the penetration hole portion 26*a* is smaller than a hole sectional area Sh2 of the penetration hole portion 21*b*1. That is, the diameter ϕ c of the penetration hole portion 26*a* is smaller than the diameter ϕ b of the penetration hole portion 21*b*1. For example, the diameter ϕ b is 0.8 mm, and the diameter ϕ c is 0.3 mm.

When the worker mounts the vent passage forming plate 26 in the inner circular area of the guide rib 21*b*3, the penetration hole portion 26*a* is positioned to be connected with the penetration hole portion 21*b*1. The mounting of the vent passage forming plate 26 is easy for the worker because the guide rib 21*b*3 is formed in a protruding manner, which is visually confirmed. That is, as shown in FIG. 7, the vent passage TR2 through which the inner space of the housing 21 communicates with the outer space of the housing 21 is configured by the penetration hole portion 21*b*1 and the penetration hole portion 26*a*, and the vent passage sectional area S2 of the smallest is the hole sectional area Sm2 of the penetration hole portion 26*a*. When the diameter 4*c* of the penetration hole portion 26*a* is 0.3 mm, the hole sectional area Sm2 is 0.07 $mm^2$.

The vent passage forming structure K2 according to the second embodiment includes the penetration hole portion 21*b*1 and the penetration hole portion 26*a* to form the vent passage TR2 through which the inner space of the front housing 21 communicates with the outer space of the front housing 21. In particular, the diameter 4*b* of the penetration hole portion 21*b*1, which will be formed on the front housing 21 by injection molding is defined to have a size capable of maintaining the productivity without having malfunctions in the pin of the die. Then, the vent passage forming plate 26 having the penetration hole portion 26*a*, which has an opening area smaller than that of the penetration hole portion 21*b*1, is mounted on the rear surface 21*b*7 of the front wall portion 21*b* of the front housing 21 such that the penetration hole portion 21*b*1 opens only at the penetration hole portion 26*a*. This enables the vent passage sectional area of the vent passage TR2 to be smaller than the sectional area of the penetration hole portion 21*b*1.

Changing the thickness of the vent passage forming plate 26 changes a length of the penetration hole portion 26*a* in an axial direction thereof. This substantially changes the length of the vent passage TR2. Moreover, mounting a plurality of vent passage forming plates 26 by piling them up substantially, also changes the length of the vent passage TR2.

Figure 10:
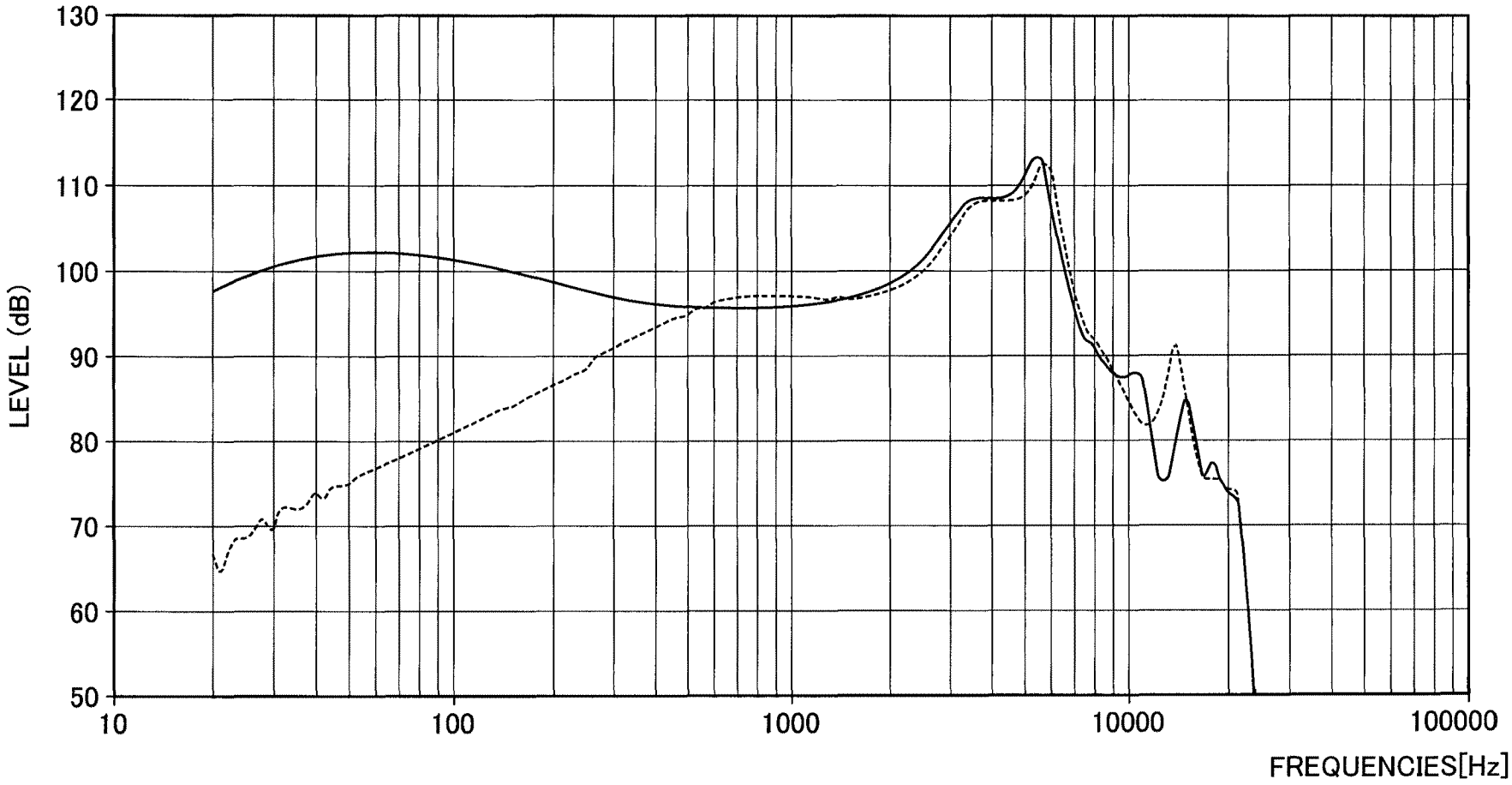
FIG. 10 is a graph illustrating frequency characteristics in reproduction according to the second exemplary embodiment.

The earphone 51 according to the first embodiment and the earphone 52 according to the second embodiment include the vent passage forming structure K1 and the vent passage forming structure K2, respectively, thereby obtaining high sound pressure particularly in low register in acoustic characteristics in reproduction. FIG. 10 is a graph illustrating a difference in acoustic characteristics in reproduction due to presence or absence of the vent passage forming structure K1. In FIG. 10, a broken line shows a characteristic in a case of providing a vent passage having the vent passage sectional area S of 0.50 $mm^2$ on the front housing 1, the vent passage configured of only the penetration hole portion 1*b*1 of 0.8 mm in diameter. A solid line shows a characteristic in a case of providing the vent passage forming structure K1 having the vent passage sectional area S of 0.07 $mm^2$ on the front housing 1. As obvious from FIG. 10, the provision of the vent passage forming structure K1 shows a rise in sound pressure in low register equal to or lower than approximate 500 Hz and enables the earphone to obtain a fine acoustic characteristic in reproduction having increased volume in low register.

The above detailed exemplary embodiments are not limited to the above described configurations and may be modified within a scope not deviating from the gist of the present invention.

The earphones 51, 52 may have the vent passage forming structures K1, K2 on the rear housings, respectively, through which a rear space Vb (see FIG. 1) with respect to the diaphragm 4*a* of the speaker unit 4 communicates with the outer space Vg. In this case, the acoustic characteristics in reproduction of the earphones 51, 52 are also adjustable, and fine acoustic characteristics in reproduction are obtained. This provides a penetration hole portion through which a space on one side of the housing 21 communicates with a space on the other side of the housing 21, so that an outer space communicates with the first space or the second space of the housing 21.

The vent passage forming structure K1 according to the first exemplary embodiment may have the inner space and the outer space reversed. That is, the groove portion 1*b*2 may be formed on a front surface 1*b*8 (FIG. 1), which is an outer surface of the front housing 1, and the vent passage forming plate 6 may be mounted on the front surface 1*b*8.

In the vent passage forming structures K1, K2 according to the first and the second exemplary embodiments, the holes of the penetration hole portions 1*b*1, 21*b*1 may not be circular holes, and the cross-sectional shape and the opening shape thereof may be any shapes. Moreover, the form of extending and the direction of extending of the groove portion 1*b*2 of the vent passage forming structure K1 are not limited to the circular arc shape and the circumferential direction. The form may be a line form, and the direction may be a diameter direction, for example.

Figure 11:
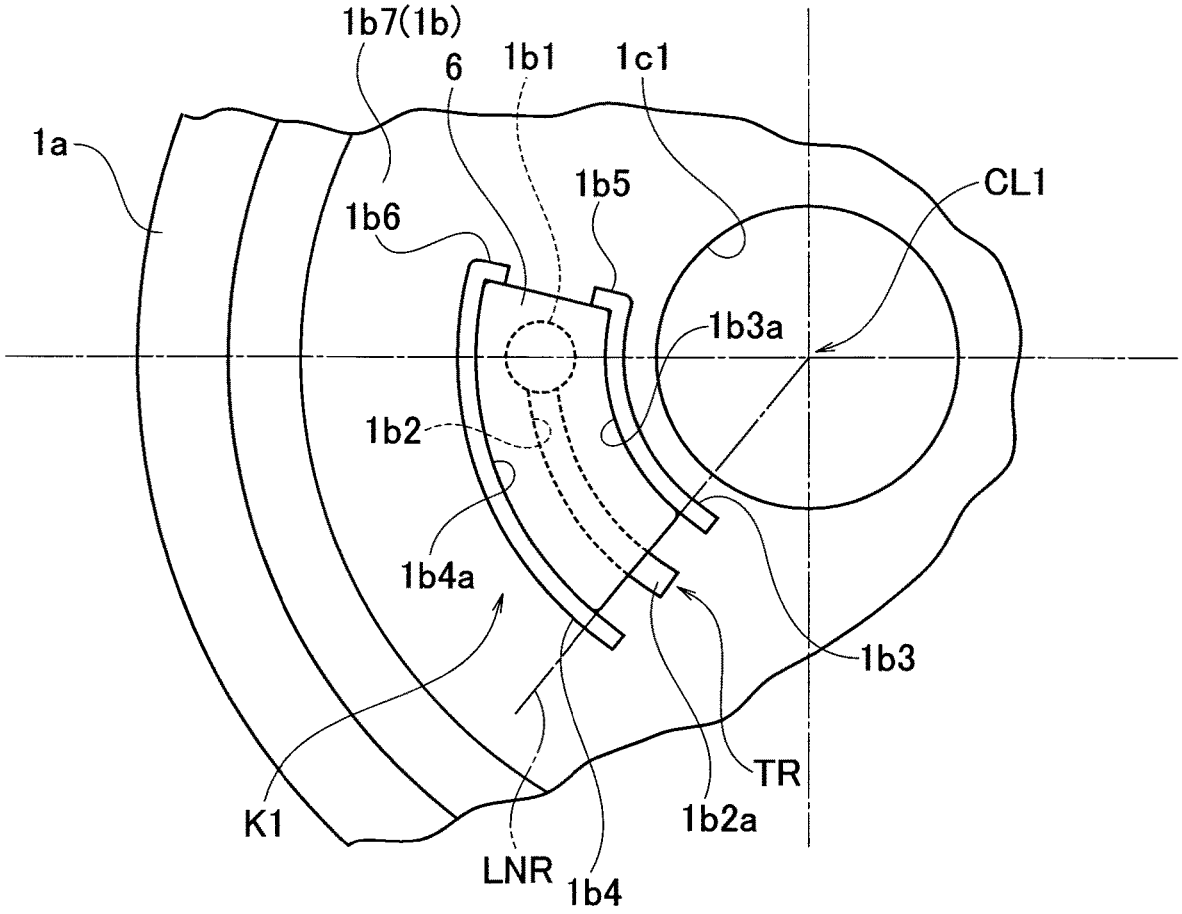
FIG. 11 is a partial rear diagram illustrating a modification of the position regulating portions, in which position regulating portions are formed at positions different from those of the first exemplary embodiment.

As shown in FIG. 11, the position regulating portions 1*b*5, 1*b*6 of the vent passage forming structure K1 according to the first exemplary embodiment may be formed on respective end portions of the inner guide rib 1*b*3 and the outer guide rib 1*b*4, the end portions closer to the penetration hole portion 1*b*1 (upper end portions in FIG. 11), along a radius line of the front housing 1. In this case, the position regulating portions 1*b*5, 1*b*6 are considered as the positioning standards, and the vent passage forming plate 6 having a different circumferential length L6 is mounted to form the vent passage TR having a different length.

The present invention has an effect of forming the vent passage having a smaller vent passage sectional area, through which the inner space of the housing communicates with the outer space of the housing.

What is claimed is:

1. A vent passage forming structure of an earphone comprising:

a penetration hole portion through which a space on one side of a housing communicates with a space on the other side of the housing, that is formed on the housing of the earphone and;

a groove portion that is formed on a surface of the housing on the one side thereof to be connected with the penetration hole portion; and a vent passage forming plate that covers the penetration hole portion and a part of the groove portion which is located at a side of the penetration hole portion, wherein a vent passage through which the space on the one side communicates with the space on the other side, is formed by a hole space that is an inner space of the penetration hole portion and a groove space that communicates with the hole space and is surrounded by the groove portion and the vent passage forming plate, and wherein a cross-sectional area of the groove space is smaller than a cross-sectional area of the hole space.

2. The vent passage forming structure of the earphone according to claim 1, further comprising:

a guide that guides the vent passage forming plate to a mounting position, the guide enabling at least visual confirmation of the mounting position.

3. An earphone comprising:

a speaker unit that includes a diaphragm;

a housing that receives the speaker unit therein to form a first space on one side with respect to the diaphragm and a second space on the other side with respect to the diaphragm;

a penetration hole portion through which an outer space communicates with the first space or the second space of the housing, that is formed on the housing;

a groove portion that is formed on an outer surface or an inner surface of the housing to be connected with the penetration hole portion; and a vent passage forming plate that covers the penetration hole portion and a part of the groove portion, wherein a vent passage through which the outer space communicates with the first space or the second space, is formed by a hole space that is an inner space of the penetration hole portion and a groove space that communicates with the hole space and is surrounded by the groove portion and the vent passage forming plate, and wherein a cross-sectional area of the groove space is smaller than a cross-sectional area of the hole space.

4. The earphone according to claim 3, further comprising:

a guide that guides the vent passage forming plate to a mounting position, the guide enabling at least visual confirmation of the mounting position.

* * * * *